United States Patent [19]

Feng

[11] 4,291,900

[45] Sep. 29, 1981

[54] INDEXED BOOK

[76] Inventor: C. T. Feng, No. 238, Lane 179, Sec. 2, Nei Hu Rd., Hei Hu District, Taipei, Taiwan

[21] Appl. No.: 93,982

[22] Filed: Nov. 14, 1979

[51] Int. Cl.[3] ..... B42D 1/00; B42F 21/12

[52] U.S. Cl. ..... 281/15 R; 283/38; 283/42; 40/360

[58] Field of Search ..... 283/1 R, 36, 37, 38, 283/39, 40, 41, 42, 43, 63 R; 40/359, 360, 389, 390; 281/15 R

[56] References Cited

U.S. PATENT DOCUMENTS

| | | | |
|---|---|---|---|
| 197,345 | 11/1877 | Denison | 283/42 |
| 433,223 | 7/1890 | Wells | 283/37 |
| 779,525 | 1/1905 | Campbell | 283/38 |
| 955,735 | 4/1910 | Wood | 283/37 |
| 3,282,268 | 11/1966 | Jacobs | 40/359 X |
| 3,877,729 | 4/1975 | Friedman | 283/37 X |

FOREIGN PATENT DOCUMENTS

| | | | |
|---|---|---|---|
| 698252 | 10/1953 | United Kingdom | 283/38 |

*Primary Examiner*—Paul A. Bell
*Assistant Examiner*—John S. Brown
*Attorney, Agent, or Firm*—Armstrong, Nikaido, Marmelstein & Kubovcik

[57] ABSTRACT

We provide an indexed book such as a dictionary, divided up into different alphabetical sections, the pages of each section having a cut-out for viewing the initial letter of all the words in that section and an elongate slot above which is printed the second and third letters of the words printed on that page. The height of the slots are arranged so that the second and third letters printed on one page appear just below the upper edge of the slot in the previous page.

1 Claim, 3 Drawing Figures

INDEXED BOOK

FIELD OF THE INVENTION

This invention relates to an indexed book such as a dictionary, encyclopaedia, address book, thesaurus, or any other form of book which facilitates rapid access to a required word, name phrase or address.

PRIOR ART

Nowadays, dictionaries and encyclopaedias are eagerly demanded by most people for reference and for obtaining knowledge. Conventional dictionaries or encyclopaedias usually have plain page margins although some are provided with labels or tabs to indicate the pages on which the initial letter of the required word is to be found. These labels or tabs usually have printed thereon a letter of the alphabet which enables a user to find at least that section in which all the words appear having the same initial letter. However once having found the right section it requires some time to identify the page on which appears the words having the same second and third letters of the alphabet as the word being searched.

SUMMARY OF THE INVENTION

In accordance with the present invention I provide a book having a plurality of sections, each section including pages having a cut-out along one free edge thereof, the length of each cut-out diminishing from the beginning to the end of each section with a symbol on each page or group of pages showing the word range of that page or pages so that the symbols on the pages of each section appear seriatum viewed from the cut-out on the front page of each section. For books such as dictionaries, encyclopaedias etc., using latin or cyrilic characters the 'symbols' comprise the first two letters of the last word on each page. For arabic, hebrew, and other similar scripts the 'symbols' comprise a commencing portion of the script of the last word on a page.

DETAILED DESCRIPTION OF A PREFERRED EMBODIMENT

It is known that the frequency at which a letter of the latin alphabet appears in a hundred thousand words is as follows: The mean appearance frequency of the first letter of a word is 1/26 in hundred thousand words, the appearance frequency of the second letter of the word is about 2/400 to 7/400 and the appearance frequency of the third letter of the word is from 1/50,000 to 1/1000. If we find the first three letters of a word in the dictionary one soon finds the word being searched. Only few words have the same first three letters which require several pages to find out the fourth letter. Basically, a word can be easily found through the first three letters, the present invention is predicted on the foregoing theory. A dictionary according to the present invention is formed from the following parts:

Part one: the dictionary is divided into 26 main alphabetical sections, each section comprises pages having semi-circular cut-outs with the first letter printed on the first or last page of that section so that the user may easily find the first letter of each word in the dictionary through the semi-circular cut-outs. Conventional dictionaries such as Webster's and the Oxford have this kind of cut-out therein.

Part two: one edge of each page is cut to form an elongate slot, the second and third letters of the word which is the last word on the page are printed just above the top edge of the slot to show the word range of that page.

Part three: the words on each page are divided into two columns (or three columns), each last word of a column is printed at the bottom edge margin of the page below the column to distinguish the exact position of the word to be consulted.

Figure 1:
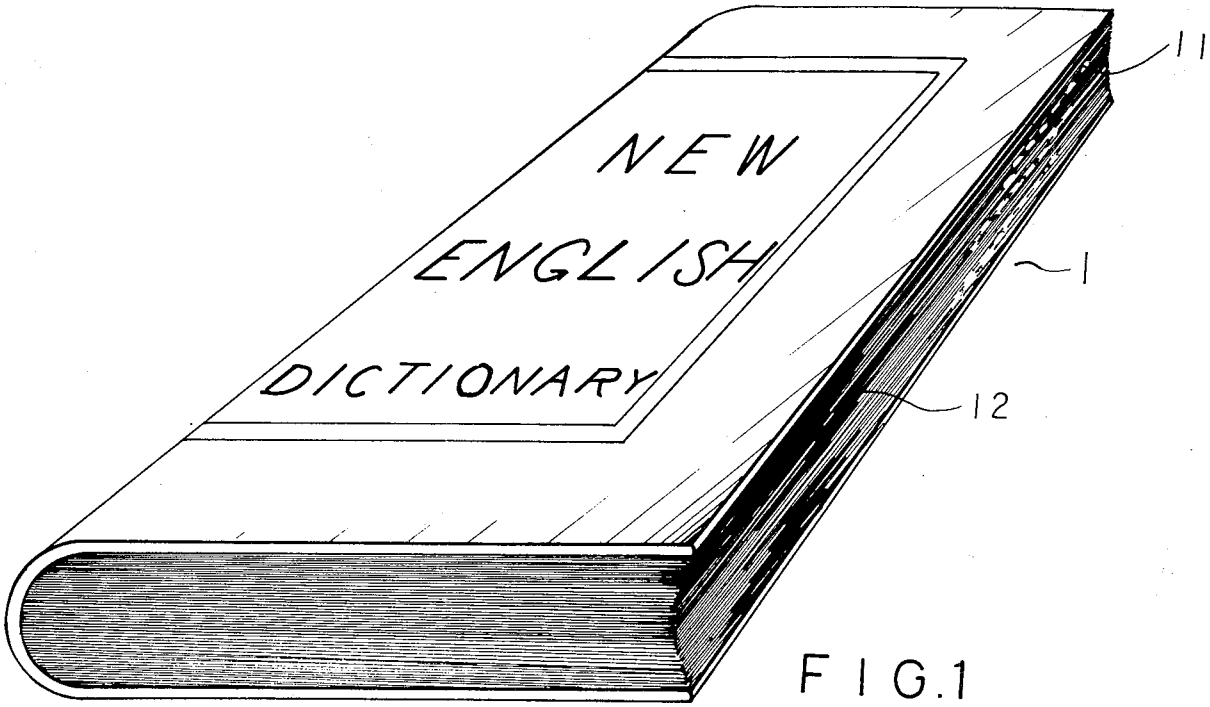
FIG. 1 is a perspective view of an English dictionary embodying the present invention.
Figure 2:
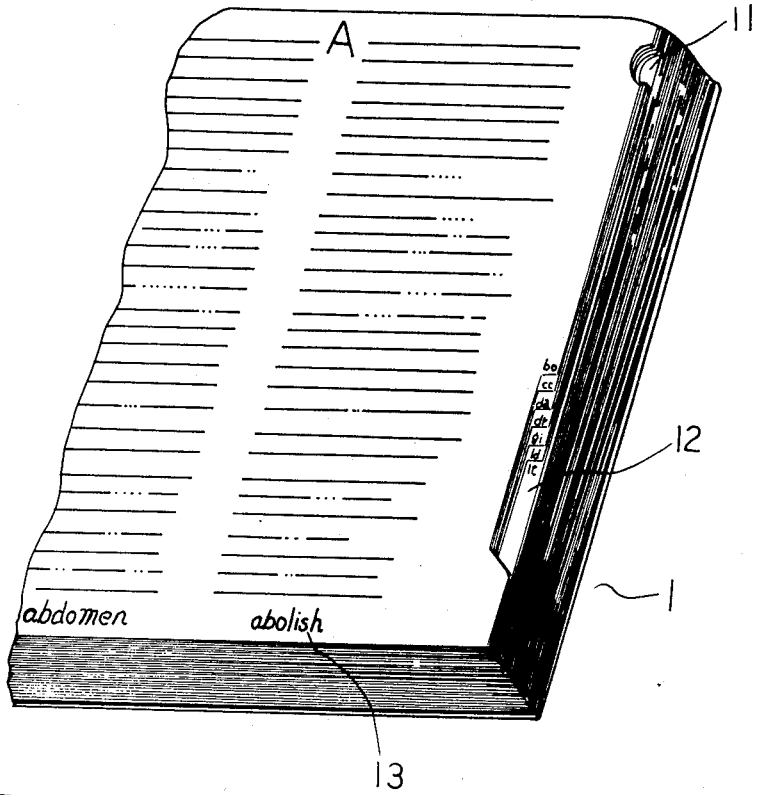
FIG. 2 is a perspective view of the first section of the dictionary illustrated in FIG. 1.
Figure 3:
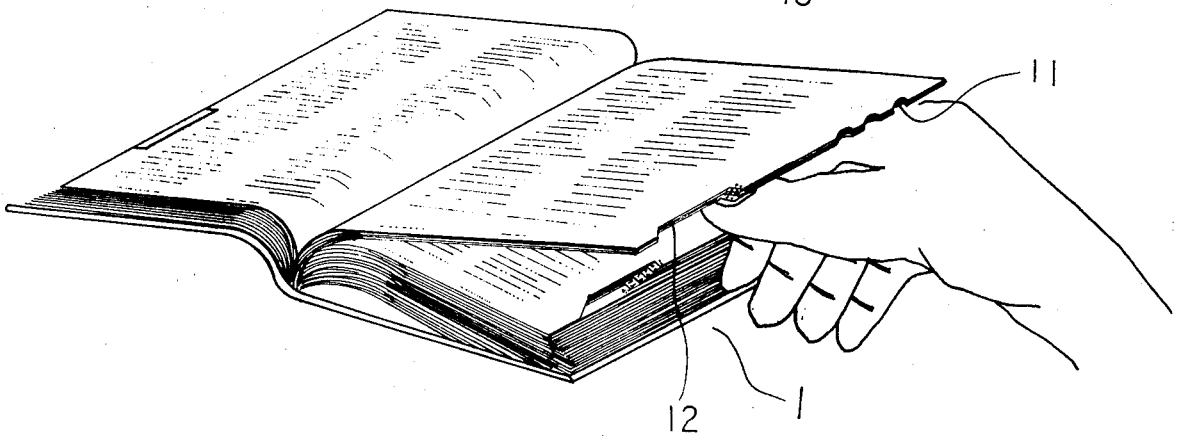
FIG. 3 shows a user referring to a page of a section of the dictionary shown in FIG. 1.

As shown in FIG. 1 and FIG. 2, dictionary 1 comprises three parts, semi-circular cut-outs 11, elongate slots 12 and bottom edge margin words 13.

The dictionary is divided into 26 main alphabetical portions, each portion comprises pages having concave semi-circular cut-outs 11 with the first letter of the word printed on the first page of that portion to show that letter of the alphabet through the cut-out.

Each page margin is cut to form an elongate slot, the second and third letters of the word which is the last word of the page are printed just above the top edge of the slot 12 thus showing the word range of that page.

The words in each page are divided into two columns (or three columns), each last word of a column is printed at the bottom of the page edge margin 13 below the column to distinguish the position of the word to be consulted.

When a word is to be consulted, for example, the word "cherish", the users open the dictionary and find the first alphabet of that word, i.e., "C" through the semicircular cut-out, then the second and third letters, i.e. "he", through the elongate slot, finally, the word range through the word columns; thus the required word is rapidly and easily found.

The purpose of the present invention is to provide a convenient system for easily and rapidly consulting the required words in a book such as a dictionary without wasting time. Users may save 4/5 of the period normally required to find a word, moreover a required word may be found by two steps only, (1) finding the first letter and (2) finding the second and third letters.

I claim:

1. A book having contents arranged in alphabetical order, characterized by that each leaf has two discrete specific zones on the opening margin of one side revealing the first letter of the indexed terms alphabetically arranged in this page, and the second and third letter of the last indexed term in this page;

each of said leaves of said book being so structured and said portions being so positioned that both said zones can be seen easily without opening said book.

* * * * *